United States Patent [19]

Birke et al.

[11] 4,178,705

[45] Dec. 18, 1979

[54] PROCESS FOR THE REDUCTION OF THE FROSTING EFFECT IN DYEING OF TEXTILE FABRICS

[75] Inventors: Walter Birke; Hans-Ulrich von der Eltz; Franz Schön, all of Frankfurt am Main, Fed. Rep. of Germany

[73] Assignee: Hoechst Aktiengesellschaft, Frankfurt am Main, Fed. Rep. of Germany

[21] Appl. No.: 825,378

[22] Filed: Aug. 17, 1977

[30] Foreign Application Priority Data

Aug. 19, 1976 [DE] Fed. Rep. of Germany ..... 2637303

[51] Int. Cl.[2] ..... D06B 3/10; D06F 69/00; D06P 5/20

[52] U.S. Cl. ..... 38/144; 28/169; 68/13 R

[58] Field of Search ..... 38/2, 144; 68/13 R, 68/169; 28/178, 182, 183

[56] References Cited

U.S. PATENT DOCUMENTS

| | | | |
|---|---|---|---|
| 201,112 | 3/1878 | Hebdon | 38/144 |
| 3,498,086 | 3/1970 | Williams et al. | 68/13 R |
| 3,732,603 | 5/1973 | Iliman et al. | 28/183 X |
| 3,811,834 | 5/1974 | Schwemmer | 38/144 X |

*Primary Examiner*—Louis Rimrodt
*Attorney, Agent, or Firm*—Curtis, Morris & Safford

[57] ABSTRACT

Process for reducing the "frosting effect" in the dyeing of textile fabrics made of staple fibers according to a continuous operation with intermediate drying, which comprises flattening the fiber ends protruding from the material web, between impregnating and drying the textile material, by the action of mechanical means onto the surface of the material web and holding them tight to the web surface by ironing, and device for carrying out the said process.

8 Claims, 4 Drawing Figures

PROCESS FOR THE REDUCTION OF THE FROSTING EFFECT IN DYEING OF TEXTILE FABRICS

Figure 1:
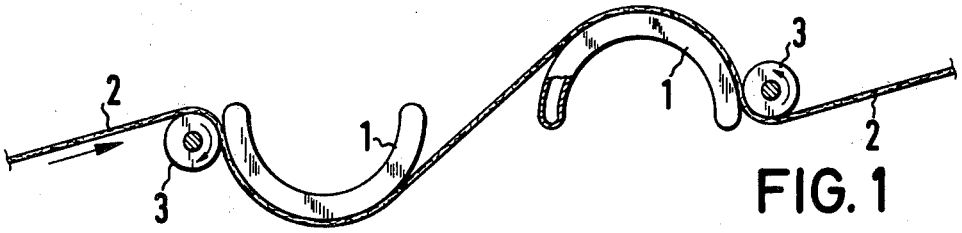

The present invention relates to a process and device for the reduction of the "frosting effect" in the continuous dyeing of textile fabrics with intermediate drying.

In the continuous dyeing of textile fabrics made of staple fibers, an effect is found in most cases which is labelled "frosting effect". This is a markedly reduced dyeing of the individual fiber ends (pile ends) protruding from the fabric surface, which effect is caused above all by a dyestuff migration in the intermediate drying of the fabrics. Said "frosting" may occur on fabrics made of synthetic fibers as well as on those made of natural fibers or fiber mixtures. The "frosting effect" is seen most clearly in the case of polyester fibers and spun rayon, and the problem of "frosting" is faced in practice predominantly in the continuous dyeing of mixed fabrics made of polyester fibers and spun rayon. The most simple continuous method of operation for mixed fabrics made of polyester fibers and spun rayon, in which the problems with regard to the "frosting" arise, is described by the measures indicated in the following within the dyeing process:

Padding-drying-thermosoling-cross-dyeing of the spun rayon portion or fixing of the dyestuffs on the spun rayon-after-treating.

In order to avoid the "frosting effect" with determined fabric qualities, which show a strong tendency towards this undesired effect due to their surface properties, the expert has had in most cases no other choice so far, but to dye these articles in a batchwise exhaustion dyeing process. Slight improvements with regard to the appearance of the goods can be obtained in the continuous operation method by adding various thickening and/or selected auxiliary agents to the padding liquor (said agents having as their basis oxalkylated compounds in almost every case). For the most part, these products involve an increase of the viscosity of the padding liquor.

It has now been found that the "frosting effect", which occurs in the dyeing of textile fabrics made of staple fibers according to a continuous operation with intermediate drying and which adversely affects the quality of the dyeings, can be avoided, or reduced to a considerable degree, by flattening the fiber ends protruding from the material web onto the surface of the web between impregnating and drying the textile material by the action of mechanical means, and by holding them tight to the web surface by ironing.

In accordance with the process of the invention, the wet textile web is guided-following the impregnation treatment, for example, upon leaving the padder-in a sliding manner either over stationary vaulted surfaces or over rotating rollers being arranged in the direction transverse to the run of fabric and is then led to, for example, a stenter frame for the admission of heat. In the course of these measures the pile ends having an adverse influence on the appearance of the goods and protruding from the fiber structure are mechanically glued onto the material web, the surface of the dyed goods being thus finished. The effectiveness of the mechanical treatment, which may be effected alternatively on one side or suitably on either side of the textile web, can even be intensified by adding products having a gluing effect to the impregnation bath. Such appropriate substances are, for example, low-viscosity alginates.

If according to the invention there are used rotating rollers, their sense of rotation may be the same or contrary to the direction of the fabric run. In order to obtain the desired "ironing" or "sliding" effect, it is important that the circumferential speed of the rotating rollers is in no case equal to the material rate, except for the case where the sense of rotation is contrary to the direction of the run of fabric. Thus, the rollers do not serve as live guide elements for the material web, but are driven individually, the desired "ironing effects" optionally being adjusted depending on the material properties by modifying the number of revolutions and the sense of rotation. The rollers are advantageously driven in a direction contrary to that of the fabric run. In this case the circumferential speed (number of revolutions $\cdot 2r\pi$) is preferably in the range of from 1/10 to 10 times the value of the material rate.

An appropriate device for carrying out the novel process, which is also a subject of this invention, consists essentially of one or several stationary vaulted surfaces or rotating rollers and optionally guide elements for the material web which are arranged one after the other in a separate position, but parallel to each other, and in the direction transverse to the run of fabric. These vaulted surfaces or rollers are suitably provided with very smooth, coated or polished surfaces. As materials for mechanical means of this kind, over which the material web is guided in a sliding manner, there should be chosen those, with which there is no static charge or said charge can be carried off, for example metal, glass, plastics or other appropriate materials. The device itself is arranged between the impregnation and drying aggregates.

Examples for the devices according to the present invention have been illustrated below diagrammatically by way of drawings.

Figure 2:
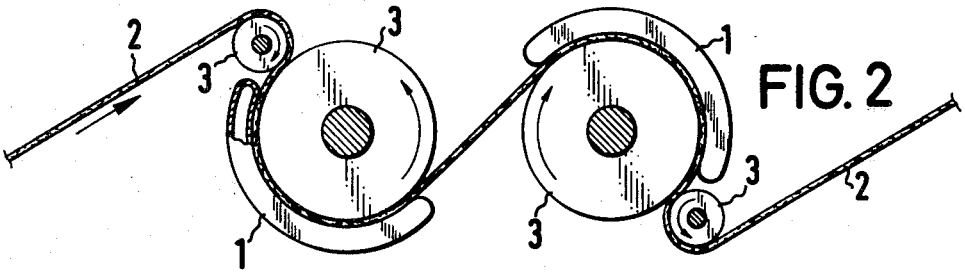
Figure 3:
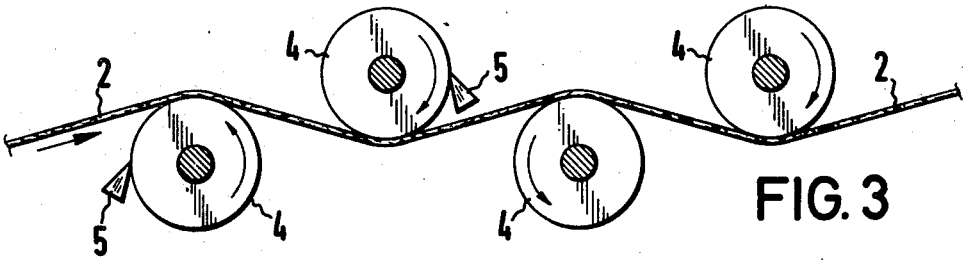
Figure 4:
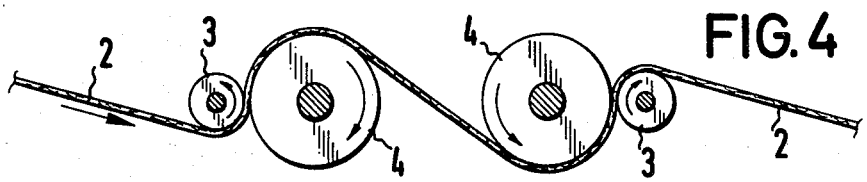

FIGS. 1 and 2 show, in side-view, embodiments of apparatus according to the invention having stationary curved surfaces; and FIGS. 3 and 4 show, in side-view, embodiments of apparatus according to the invention having rotating rollers. In these figures, the impregnation and drying devices have not been shown, since for this purpose there may be used all known aggregates. The impregnation may be effected, for example, by padding, slop-padding, spraying, foaming, etc.; as drying devices there are mentioned infra-red pre-driers, hotflues, stenter frames, cylinder driers, burning-off units, etc.

In its simplest variant, the device of the invention according to FIGS. 1 and 2 consists of stationary elements, especially vaulted plates (1), which may also be designed as oval or cylinder-shaped hollow parts (not shown) and over which the material web (2) is guided in a sliding manner. Guide elements for the material (3), for example guide rollers, ensure that the textile material in its open width remains in a sliding contact with the surface of (1).

As movable sliding elements there are mentioned rotating rollers (4) in the first place. An arrangement of this kind will suitably comprise at least two rollers. Depending on the quality of the goods and the desired effect, the material may be guided round the rollers (4) with less (FIG. 3) or more (FIG. 4) contact.

Apart from special fabrics and/or specially desired oneside effects, the device has been designed in such a manner that both sides of the fabric may be treated in the same way, i.e. the vaulted surfaces and/or rollers are arranged on either side of the material web.

The treatment of textile materials with very high deposits of liquid is effected preferably by means of movable devices instead of stationary ones. In this case it may also be advantageous if doctor blades (5) or similar appliances are installed at the rotating rollers, which will strip off a liquid film possibly adhering to the roller surfaces.

We claim:

1. In a continuous process for uniform dyeing a web of textile material containing staple fibres of polyester or spun rayon, which process comprises dyeing, intermediate drying and dyestuff fixation steps, the improvement which comprises: applying pressure against a surface of the said textile material after said material has been dyed but prior to intermediate drying, whereby fiber ends protruding from the said surface are caused to adhere to said surface, and thereby uniformly dyeing each fiber in the material.

2. A process as claimed in claim 1, wherein the surface of said textile material is caused to be in motion relative to a stationary curved surface or a rotating roller having its longitudinal axis in the direction transverse to the direction of movement of, and parallel to the plane of the material.

3. A process as claimed in claim 1, wherein the surface of said textile material is caused to be in motion relative to a rotating roller which is rotated such that the roller surface in contact with the material surface is moving in the same direction as the material but at a different speed.

4. A process as claimed in claim 1, wherein the surface of said textile material is caused to be in motion relative to a rotating roller which is rotated such that the roller surface in contact with the material surface is moving in the opposite direction to the material.

5. A process as claimed in claim 4, wherein the circumferential speed of the roller is in the range of from 1/10 to 10 times the material speed.

6. A process as claimed in claim 1, wherein pressure is applied to both sides of the textile material.

7. A process as claimed in claim 1, wherein the material is impregnated during the said dyeing step with an agent that assists adhesion of the fibre ends to the textile material surface.

8. A process as claimed in claim 7, wherein the adhesion-assisting agent is a low-viscosity alginate.

* * * * *